US011566778B1

(12) United States Patent
Zheng et al.

(10) Patent No.: US 11,566,778 B1
(45) Date of Patent: Jan. 31, 2023

(54) JOINABLE LAMP STRUCTURE

(71) Applicant: FUJIAN OUMEIDA ELECTRIC MACHINE CO., LTD., Fuan (CN)

(72) Inventors: Yao Fu Zheng, Fuan (CN); Qi Heng Guo, Fuan (CN)

(73) Assignee: FUJIAN OUMEIDA ELECTRIC MACHINE CO., LTD., Fujian Province (CN)

( * ) Notice: Subject to any disclaimer, the term of this patent is extended or adjusted under 35 U.S.C. 154(b) by 0 days.

(21) Appl. No.: 17/888,730

(22) Filed: Aug. 16, 2022

(51) Int. Cl.

| | |
|---|---|
| ***F21V 15/015*** | (2006.01) |
| ***F21V 21/005*** | (2006.01) |
| ***F21S 8/06*** | (2006.01) |
| ***F21S 8/02*** | (2006.01) |
| ***F21V 21/02*** | (2006.01) |

(52) U.S. Cl.
CPC ..... *F21V 21/005* (2013.01); *F21S 8/026* (2013.01); *F21S 8/06* (2013.01); *F21V 15/015* (2013.01); *F21V 21/025* (2013.01)

(58) Field of Classification Search
CPC .... F21V 15/015; F21V 21/005; F21V 21/025; F21S 8/02; F21S 8/026
See application file for complete search history.

(56) References Cited

U.S. PATENT DOCUMENTS

2021/0148531 A1* 5/2021 Donnelly ..... F21S 8/061

* cited by examiner

*Primary Examiner* — Sean P Gramling
(74) *Attorney, Agent, or Firm* — Karin L. Williams; Mayer & Williams PC

(57) ABSTRACT

The present invention discloses a joinable lamp structure, which is made by joining two neighboring lamps through a joining component. A side cap is used to cover the exposed ends of the lamps. After the assembly, the present invention can be embedded inside the mounting slot of the ceiling or suspended below the ceiling.

4 Claims, 10 Drawing Sheets

JOINABLE LAMP STRUCTURE

FIELD OF THE INVENTION

The present invention relates to a joinable lamp structure, and more particularly to a lamp device capable of connecting and assembling the juxtaposed lamp to be long shape.

DESCRIPTION OF RELATED ART

A lamp is a device that converts electrical energy into optical energy. A conventional lamp generally has an outer shell (named as lamp shell or lampshade) covering the lamp and a light-emitting component (can be in any light-emitting mode) is installed inside the outer shell. The outer shell can be installed at an appropriate location (such as the ceiling or any other locations with no limitation). The light-emitting component is driven to emit light through being connected to an external power source via an electrical wire and supplied power (e.g., municipal electricity or any other power sources with no limitation), which powers the lamp to emit light. Thus, by controlling the switch of the power source, the electricity supplied to the light-emitting component can be connected or disconnected, so that it is turned on or off.

For downward illumination, it is common to install long shaped cuboid lamps on the ceiling. The lamp shell is in the shape of a long cuboid bar, and light emitting components are installed inside the shell. For a good sense of sight, the length and width are of an appropriate proportion. That is to say, the shell of the lamp has a fixed length, and the ceiling will be provided with a matching square slot, so that the lamp shell can be perfectly embedded inside the square slot. As the length of this kind of lamp shell is limited, when longer (more) light source is required on the ceiling, the ceiling must be provided with a plurality of square slots adjacent to each other, and each slot is embedded with one lamp. As the distance between the adjacent square slots can be very small, when the plurality of lamps are lighted up, a line-shaped light source can be formed.

Along with the rapid social development, the requirement for interior decoration is becoming increasingly higher. As the prior-art long shaped cuboid lamps cannot be joined end to end, the ceiling must be accordingly provided with separated square slots, and when installing the lamps, each lamp must be installed separately. This is quite inconvenient for lamp installation workers. In view of this, the present invention aims to provide a solution for joining multiple long shaped cuboid lamps for the convenience of decoration or lamp installation workers.

SUMMARY OF THE INVENTION

In view of the inconvenience for decoration and lamp installation due to the fact that the prior-art long shaped cuboid lamps cannot be joined end to end on the neighboring sides, the inventor has carried out in-depth research and tried different solutions for improvement before completing present invention.

Therefore, the main objective of the invention is to provide a solution to join multiple long shaped cuboid lamps end to end on the neighboring sides, so as to facilitate decoration and lamp installation.

To achieve the above-mentioned objective, the present invention provides a joinable lamp structure, which is an entire lamp device made by joining at least two lamps end to end, wherein, each lamp comprises an outer shell covering on the outside and a light emitting component installed inside the outer shell, the outer shell is in a cuboid bar shape, and can be divided into a long side lateral face and a short side lateral face, at the positions of a certain distance to the head and tail ends, the long side lateral face is provided with an inserting slot recessed inward and going out upward, the bottoms of the head and tail ends are respectively protruded with a stop block, a limiting space is formed between the stop block and the long side lateral face, the bottoms of the two stop blocks of the long side lateral face extends outward to form a positioning stop plate, the short side lateral face of the outer shell is recessed on the head end and the tail end, so that a positioning convex bar is respectively formed on the left side and the right side, the top face of the outer shell is respectively provided with a first joining slot at positions of a certain distance to the head end and the tail end, and a second joining slot is formed at the middle positions of the left side and the right side, when the head and tail ends of the two neighboring lamps are aligned and placed end to end, a joining component can be used to connect the two lamps, the joining component is formed by connecting a left side edge, a right side edge, and a top edge and is shaped like a C, the bottom edge in the middle of the outer wall of the side edge is recessed and is protruded with a pair of inserting plates, between the two inserting plates, a clamping slot is formed, the head and tail ends of the side edge is formed with a connecting lug, the top edge is provided with a connecting hole at the middle positions of the head and tail ends, align the head end and the tail end of the two neighboring lamps so that the neighboring positioning convex bars are correspondingly put together, and align the open mouth of the C-shaped joining component to the outside of the ends of the two neighboring lamps and insert in from above, so that the connecting lug of the joining component is inserted into the corresponding inserting slot, the inserting plate of the joining component is correspondingly inserted into a limiting space, and is immediately pressed by the stop block, the clamping slot of the joining component perfectly clamps the bent and connected walls of the two neighboring stop blocks, each connecting hole of the joining component corresponds to a first joining slot, a connecting component is inserted from above, passing the connecting hole and is locked in the first joining slot, so that the joining component is connected with the ends of the two neighboring lamps on the outside.

According to the above-mentioned joinable lamp structure, wherein the exposed ends of the outer shell is covered by a side cap, the side cap has a vertical wall, the top edge of the vertical wall is folded inward and extended to form a top wall, and at a position close to the middle of the front edge, a connecting hole is provided, the inner face of the vertical wall is respectively configured with an abutting wall at positions close to the left side and right side, the left side edge and right side edge of the vertical wall are respectively configured with an upside-down L-shaped limiting plate, the folding position of the upside-down L-shape forms an abutting space, the bottom edge of the vertical wall is folded toward the outside and is expanded to form a positioning stop plate, press the side cap upon the exposed end of the lamp, so that the two abutting walls on the inner surface of the vertical wall are both pressed upon the wall in the recessed space on the short side lateral face of the outer shell, the two positioning convex bars on the short side lateral face of the outer shell are respectively pressed upon the two side edges on the inner face of the vertical wall, the upside-down L-shaped limiting plate goes through the abutting space and is pressed upon the stop block of the outer shell, the positioning stop plate is connected to the positioning stop plate of the outer shell, the top wall covers the top side of the end of the outer shell, and the connecting hole of the top wall is aligned to the first joining slot of the outer shell, a connecting component goes from above and through the connecting hole of the top wall and is locked with the first joining slot, so that the side cap firmly covers the end of the outer shell.

According to the above-mentioned joinable lamp structure, wherein, the second joining slot of each lamp is fixed through a screw with a limiting and connecting plate, the limiting and connecting plate is a plate extending downward and then outward and upward for several cycles to have an elasticity, the ceiling is provided with a long shaped hollow locking slot, its length and width is equal to the length and width of the complete joined lamp, the joined lamp is lifted up, the limiting and connecting plate is firstly shrunk inward so that it can pass the locking slot, till the positioning stop plate is pressed upon the ceiling, during the course, the limiting and connecting plate is elastically recovered outward and is fixed on the top edge of the locking slot, so that the whole lamp device is embedded inside the locking slot without separation.

According to the above-mentioned joinable lamp structure, wherein, the second joining slot of each lamp is fixed through a screw with a suspension rope, the suspension rope is a line-shaped object extending upward, the ceiling is configured with multiple corresponding connecting holes, the joined lamp device is lifted up, each suspension rope is connected to its corresponding connecting hole, so that the whole lamp device is suspended below the ceiling without separation

DETAILED DESCRIPTION OF EMBODIMENTS OF THE INVENTION

The technical means adopted by the present invention to accomplish the above object as well as the functional effect of the invention are described in detail below with respect to a preferred embodiment and with reference to the accompanying drawings, so that they can be readily understood.

Figure 2:
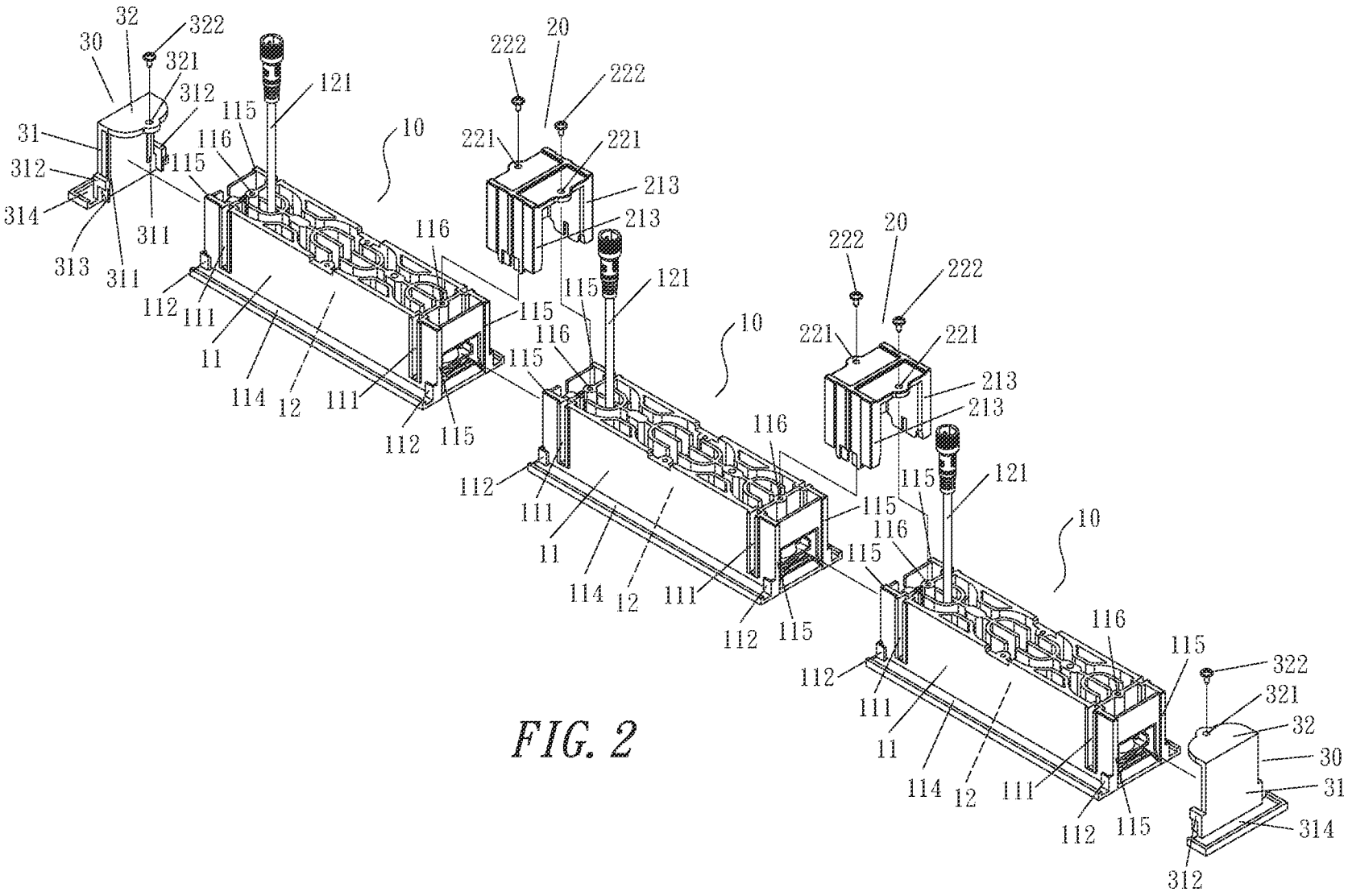
FIG. 2 is an exploded perspective view of the invention.
Figure 3:
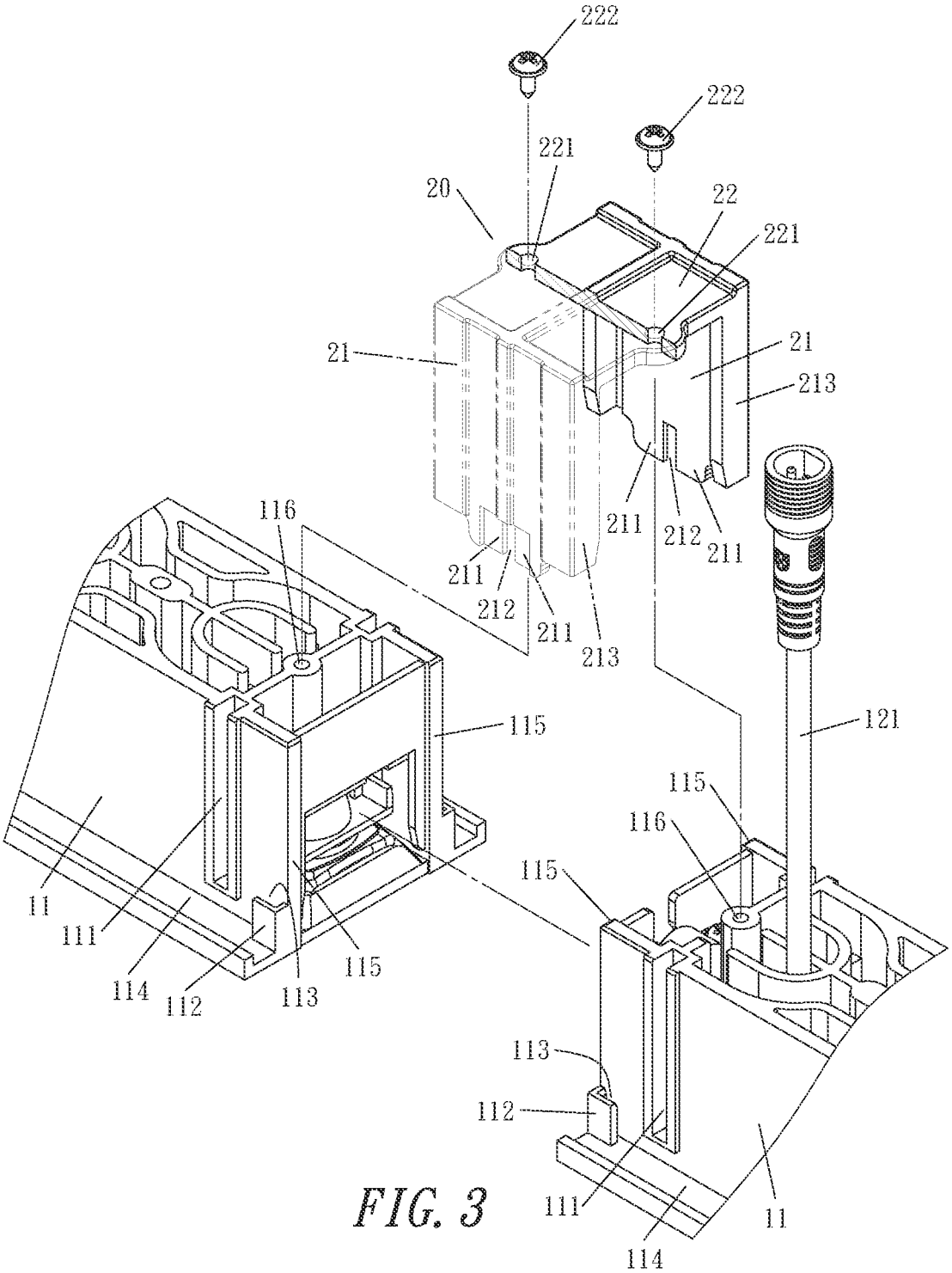
FIG. 3 is an exploded perspective view of the joining component and the ends of two lamps according to the invention.
Figure 4:
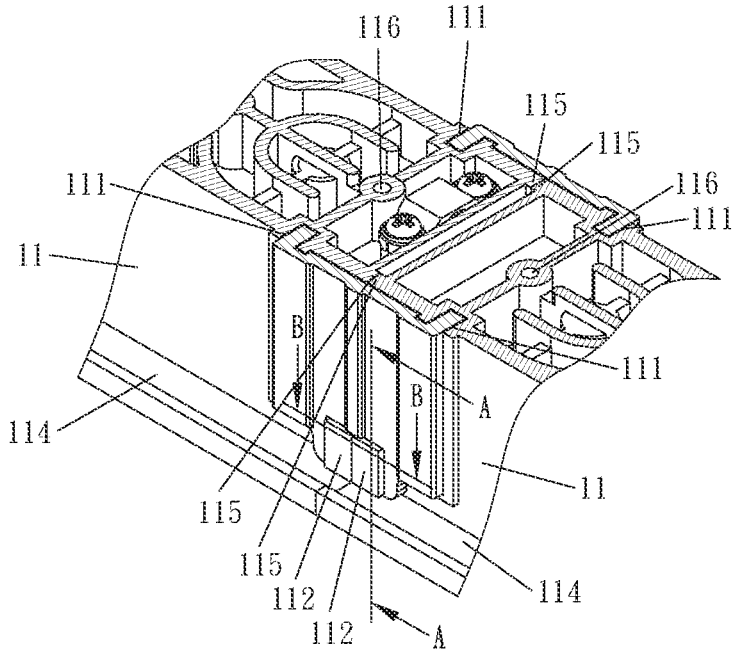
FIG. 4 is a partial sectional perspective view of the joining component and the ends of two lamps according to the invention.
Figure 5:
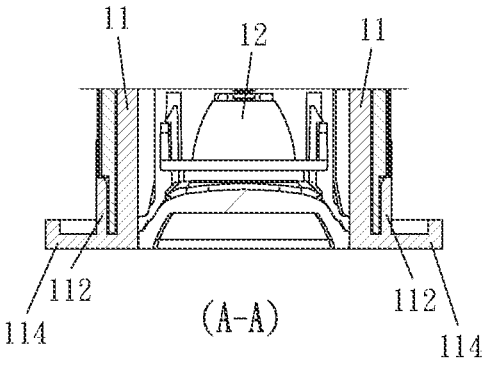
FIG. 5 is A-A section view of FIG. 4.
Figure 6:
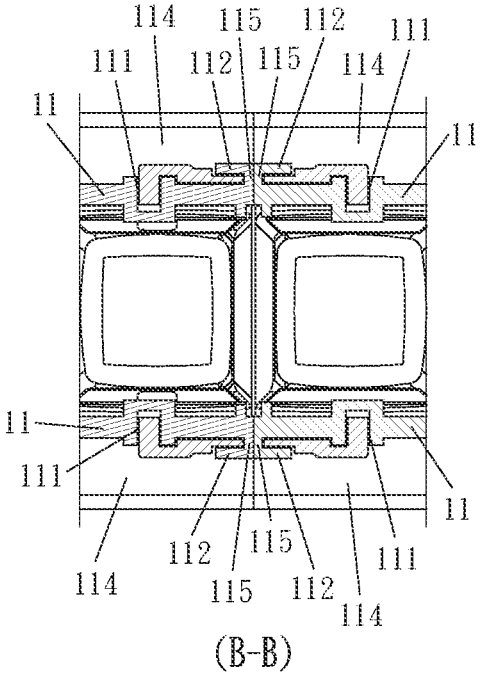
FIG. 6 is B-B section view of FIG. 4.

The overall lamp device of the invention is made by joining a plurality of lamps 10. For descriptive purposes, an example is provided in FIGS. 1-2, which discloses a lamp device made by joining three lamps 10 end to end on the neighboring sides. Each lamp 10 comprises an outer shell 11 covering on the outside and a light emitting component 12 (see FIG. 5) installed inside the outer shell. The outer shell 11 is in the shape of a long cuboid bar. In other words, when looking from different sides, the side faces can be identified as "long side lateral faces" and "short side lateral faces". Referring to FIG. 3, an inserting slot 111 is provided at a position close to the head and the tail ends on the left and right sides of the "long side lateral face". The inserting slot 111 is recessed inward and is open upward. The bottom of the head and tail ends are protruded with a stop block 112, so that a limiting space 113 (see FIG. 3) is formed between the stop block 112 and the "long side lateral faces". Then, the bottoms of the two stop blocks 112 of the "long side lateral faces" are extended with a low-depth positioning stop plate 114. The "short side lateral face" of the outer shell is recessed on the head and tail ends, so that a positioning convex bar 115 is formed respectively on the left side and the right side. The top surface of the outer shell 11 is provided with a first joining slot 116 at positions close to the head end and the tail end respectively. And a second joining slot 117 is provided at the middle position of the left end and the right end respectively. The top surface of the outer shell 11 is formed with a heat radiating space, and the bottom surface is provided with components to enhance light projection. However, this is not related to the features of the invention and is therefore not described in detail.

The light emitting component 12 installed inside the outer shell 11 (see FIG. 5) can be in any light emitting mode. Also, this is not related to the features claimed by the invention. However, the light emitting component 12 must have a power connection cord 121 extending out.

Then, referring to FIGS. 3-6, when the two neighboring lamps 10 are placed end to end, they can be connected through a joining component 20. The joining component 20 is in a C shape connected by a left side edge, a right side edge 21, and a top edge 22. The middle bottom edge of the outer wall of the side edge 21 is recessed and is protruded with a pair of inserting plates 211, and between the two inserting plates 211, a clamping slot 212 is formed. The head and tail ends of the side edge 21 have wider width to form a connecting lug 213. A connecting hole 221 is configured respectively at the middle positions of the head and tail ends of the top edge 22. During assembly, the head and tail ends of the two neighboring lamps 10 are placed end to end, i.e., the neighboring positioning convex bars 115 are placed close to each other (see FIG. 4). Then alight the mouth of the C-shaped joining component 20 to the ends of the two neighboring lamps 10 and insert the joining component 20 from above, so that the connecting lugs 213 of the joining component 20 are inserted into the inserting slots 111 one by one (see FIG. 4 and FIG. 6). The inserting plates 211 of the joining component 20 are respectively inserted into a limiting space 113 (see FIG. 4~FIG. 6) and are immediately pressed by the stop block 112 (see FIG. 5). The clamping slot 212 of the joining component 20 clamps the bent and joint walls of the two neighboring stop blocks 112 (see FIG. 6). Each connecting hole 221 of the joining component 20 is aligned to a first joining slot 116. Thus, a connecting component 222 (such as a screw, with no limitation) can go through the connecting hole 221 from above and be locked in the first joining slot 116, so that the joining component 20 is firmly connected with the outside of the ends of the two neighboring lamps 10.

Figure 1:
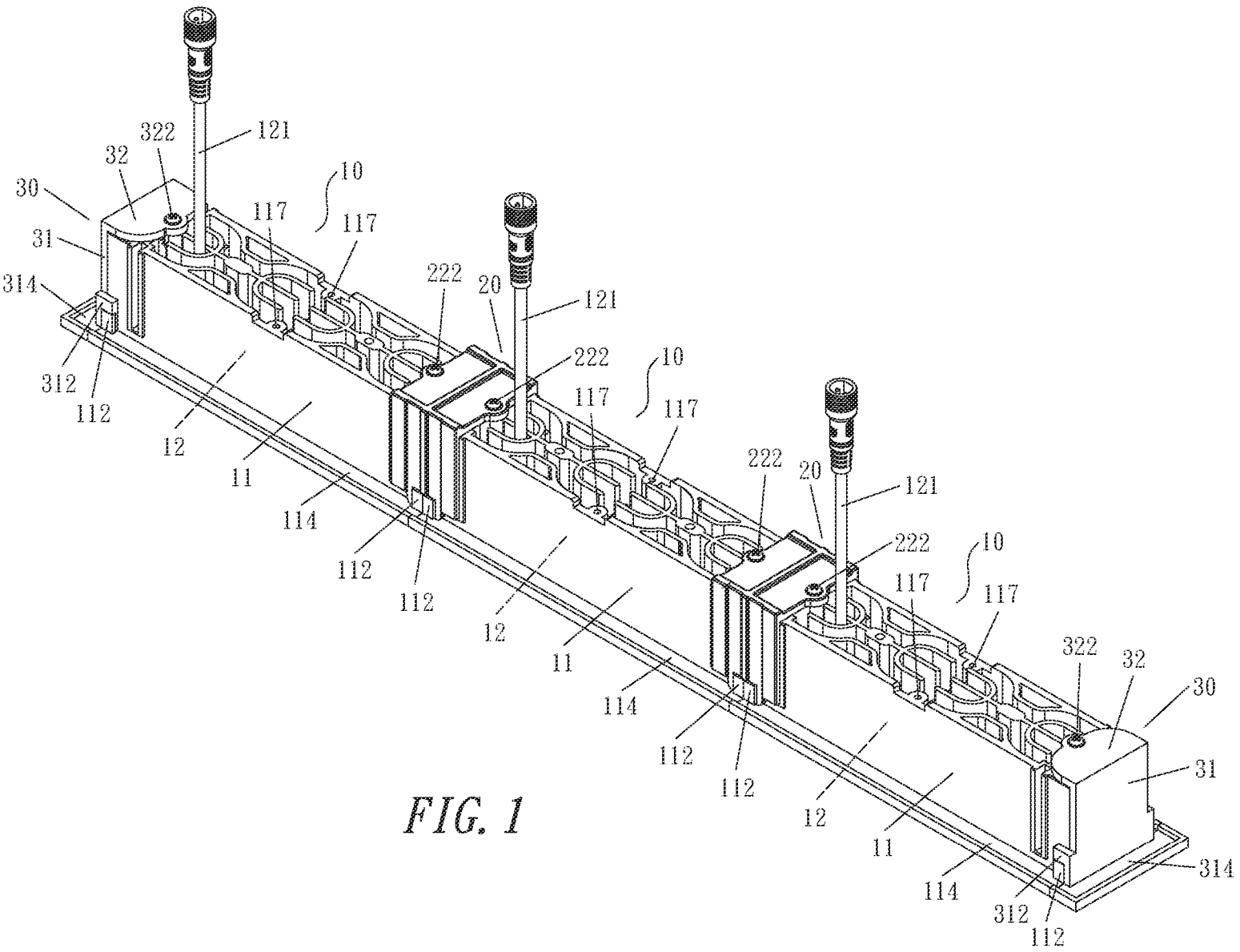
FIG. 1 is a perspective view of the invention.

Therefore, the three lamps 10 disclosed in FIG. 1 can be joined through two joining components 20 to form a lamp device in a long line shape. Similarly, four lamps 10 can be joined through three joining components 20, and five lamps 10 can be joined through four joining component 20. In the same principle, a lamp device of virtually limitless length can be formed through joining multiple lamps.

Referring to FIG. 3, the "short side lateral face" of the outer shell 11 on the head end and the tail end is formed with a positioning convex bar 115 respectively on the left side and the right side. Inside the recessed space, there is a hollow portion (for demoulding after the formation). Thus, when the ends of the two neighboring lamps 10 are connected to each other, they can be connected through the joining component 20. The unconnected and exposed end can be covered by a side cap 30 to block the hollow portion and enhance the overall appearance.

Figure 7:
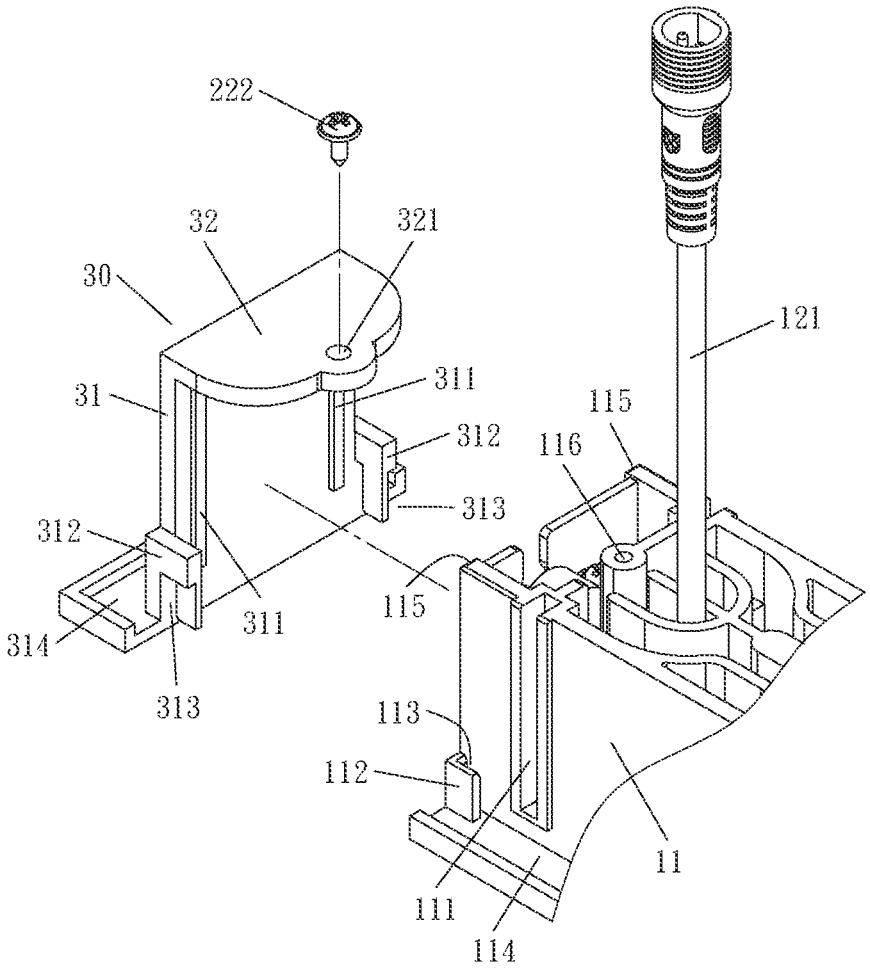
FIG. 7 is exploded perspective view 1 of the side cap and the lamp end according to the invention.
Figure 8:
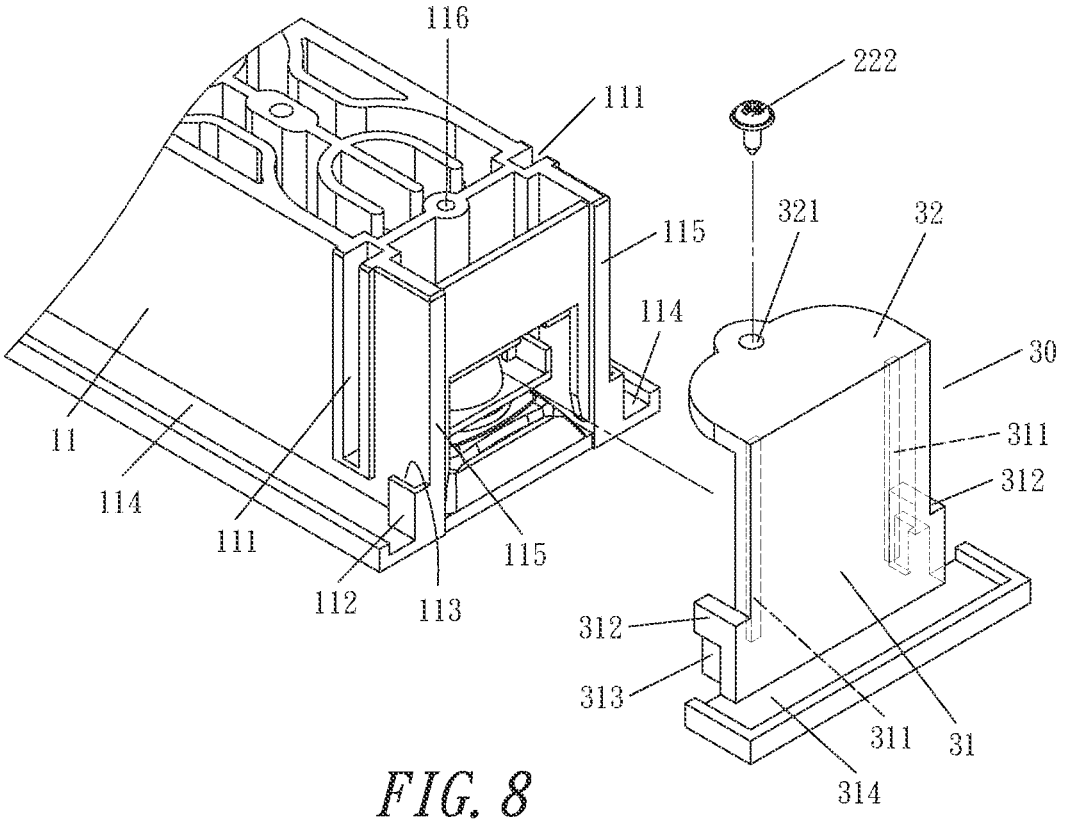
FIG. 8 is exploded perspective view 2 of the side cap and the lamp end according to the invention.

As shown in FIG. 7 and FIG. 8, the side cap 30 has a vertical wall 31. The top edge of the vertical wall 31 is bent inward and extended to form a top wall 32, and a connecting hole 321 is configured at the middle position close to the front edge. On the inner face of the vertical wall 31, an abutting wall 311 is configured respectively at positions close to the left side and right side. The left and right side edges of the vertical wall 31 are respectively configured with a upside-down L-shaped limiting plate 312. The bent position of the upside-down L shape forms an abutting space 313. The bottom edge of the vertical wall 31 is bent outward and expanded to form a positioning stop plate 314. When used, the side cap 30 is pressed on the exposed end of the lamp 10, so that the two abutting walls 311 on the inner face of the vertical wall 31 are both pressed upon the wall of the recessed space on the "short side lateral face" of the outer shell 11. The two positioning convex bars 115 on the "short side lateral face" of the outer shell 11 are respectively pressed upon the two side edges of the inner face of the vertical wall 31. The upside-down L-shaped limiting plate 312 goes through the abutting space 313 and is pressed correspondingly upon the stop block 112 of the outer shell 11. And the positioning stop plate 314 is connected with positioning stop plate 114 of the outer shell 11. The top wall 32 will cover the top face of the end of the outer shell 11, and the connecting hole 321 corresponds to the first joining slot 116 of the outer shell 11. Thus, a connecting component 322 (such as a screw, with no limitation) can go through the connecting hole 321 from above and be firmly locked inside the first joining slot 116. Therefore, the side cap 30 can firmly cover the end of the outer shell 11.

Figure 9:
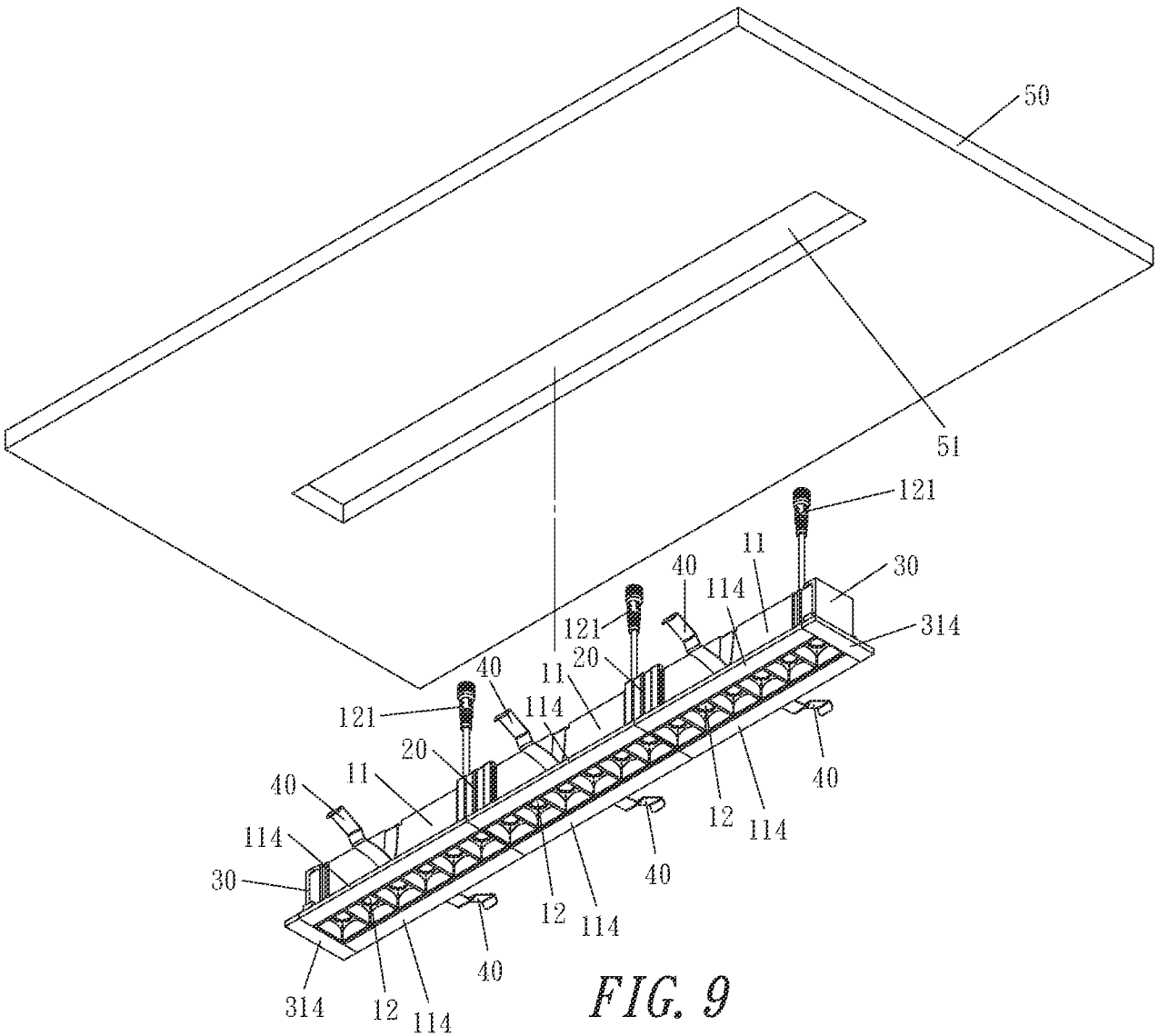
FIG. 9 is an exploded view of the invention embedded in the mounting slot of the ceiling.
Figure 10:
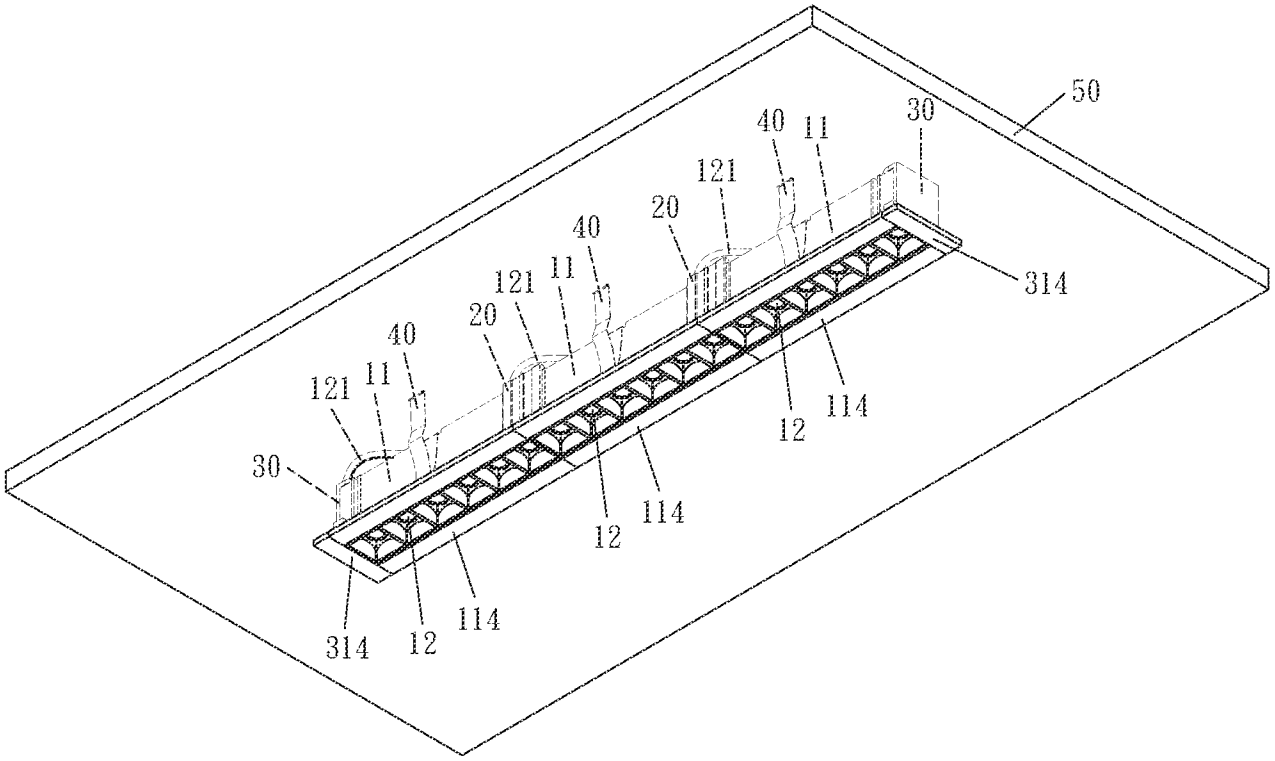
FIG. 10 is a perspective view of the invention embedded in the mounting slot of the ceiling.

When the two neighboring lamps 10 are joined through the joining component 20, and the exposed ends of the lamps 10 are firmly covered by the side caps 30, the combination of long shaped cuboid lamps with neighboring side edges is completed according to the invention. Then, the lamps connected to become a long shaped lamp device are installed on the ceiling. There are two assembly methods. The first method is disclosed in FIGS. 9-10. The second joining slot 117 on the left side and right side of each lamp 10 is locked through a screw with a limiting and connecting plate 40. The limiting and connecting plate 40 is a plate extending downward and then outward and upward for several cycles to have elasticity. The ceiling 50 is provided with a long shaped hollow locking slot 51. The length of the hollow slot is equal to the length of the joined long shaped lamp between the head side and tail side caps 30. The width of the hollow slot is equal to the width of the joining component 20. Before assembly, the ceiling 50 is provided with a power cord from above and the power cord goes through a controller. During installation, the whole joined lamp device is lifted up. Firstly, the power connection cord 121 of the lamp 10 is connected to the power cord provided above the ceiling 50. Then, the limiting and connecting plates 40 of all the lamps are shrunk inward to go through the locking slot 51, till the positioning stop plates 114, 314 is pressed upon the ceiling 50. When releasing the hand to let the limiting and connecting plate 40 elastically recover outward to be pressed upon the top edge of the locking slot 51, the whole lamp device in a long shape is embedded inside the locking slot 51 without separation.

Figure 11:
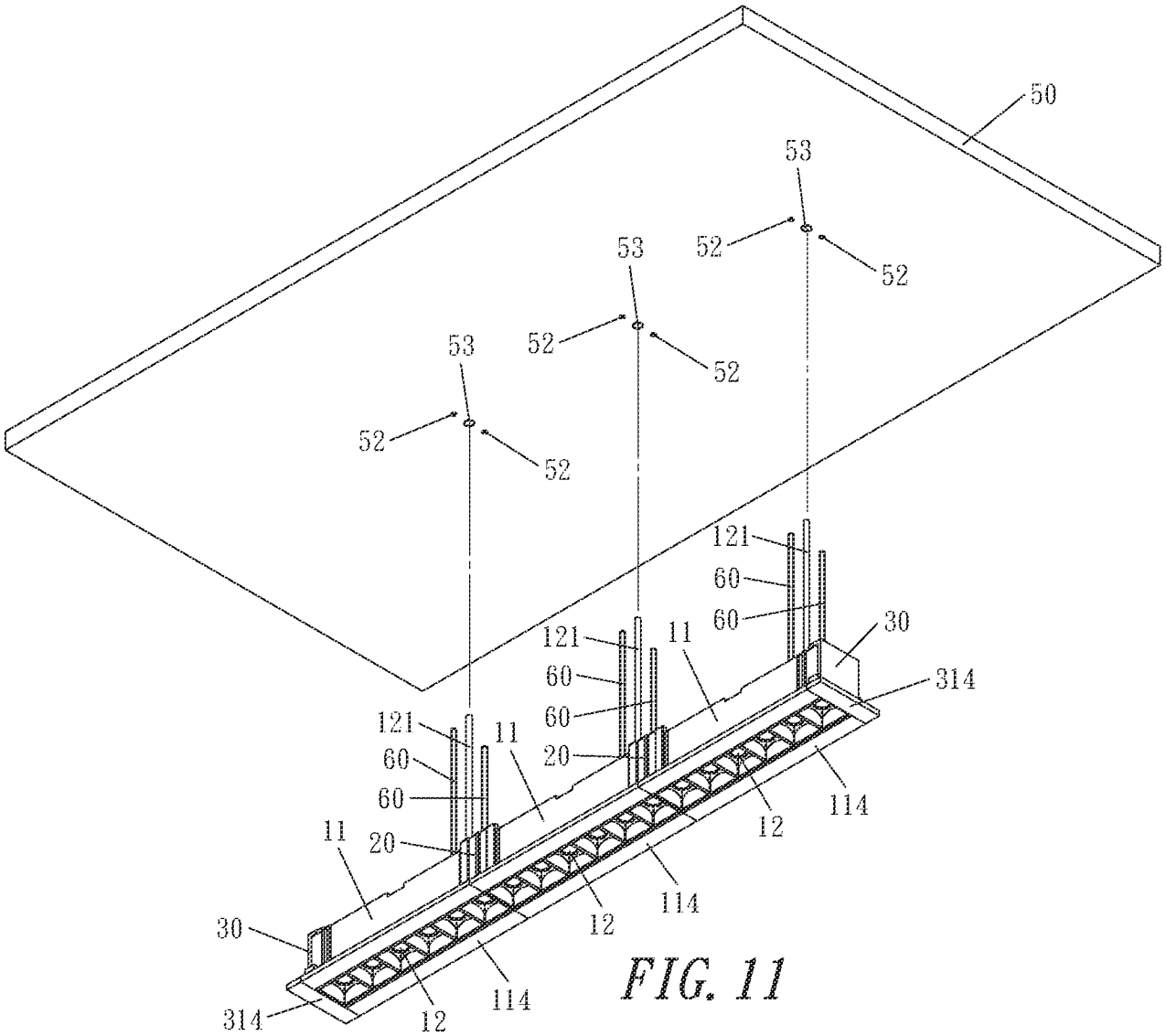
FIG. 11 is an exploded view of the invention suspended below the ceiling.
Figure 12:
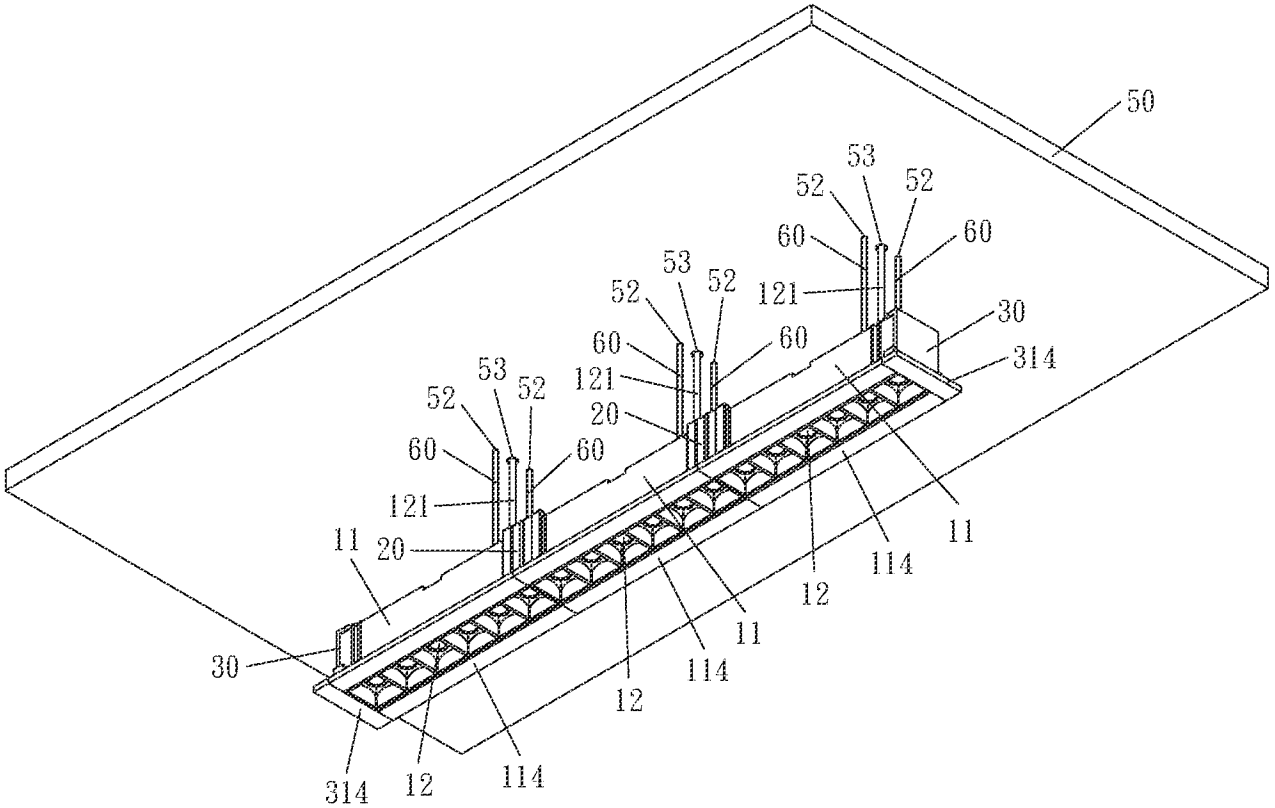
FIG. 12 is a perspective view of the invention suspended below the ceiling.

The second assembly method is shown in FIGS. 11~12. The second joining slots 117 on the left side and right side of each lamp 10 are both locked with a suspension rope 60 through screws. The suspension rope 60 is a line-shaped object extending upward. The ceiling 50 is correspondingly provided with multiple connecting holes 52 and power connecting holes 53 matching the number of the power connection cords 121. During installation, the whole joined lamps are lifted up. Firstly, the suspension rope 60 is connected to the corresponding connecting hole 52. Then, the power connection cord 121 goes through the power connecting hole 53 and is connected to the power cord provided from above the ceiling 50, so that the whole lamp device is in a long shape without separation, and is suspended below the ceiling 50.

From the above descriptions, it is known that the main claim of the present invention is joining two neighboring lamps 10 placed end to end through a joining component 20, and the auxiliary claim is covering the exposed ends of the lamps 10 using a side cap 30. After completion, the present invention can be embedded inside the locking slot 51 of the ceiling 50, or suspended below the ceiling 50.

Based on the structure of the present invention, the lamp installation worker only need to select a required number of lamps 10, use the joining components 20 to join each pair of neighboring lamps 10 placed end to end, and cover the exposed ends of the lamps 10 using the side caps 30. Thus, the combination of the whole lamp device is completed. Then, the worker can carry out the subsequent operations to embed the lamp device inside the ceiling or suspend it on the ceiling. To embed the lamp device inside the ceiling, conduct the operation to lock a limiting and connecting plate 40 through screws in the second joining slot 117 on the left side and right side of each lamp 10. Based on the overall length and width of the joined lamp, open a long shaped hollow locking slot 51 on the ceiling 50. At last, connect the power cords and embed the whole lamp inside the locking slot 51 and the whole operation is completed. To suspend the lamp on the ceiling, lock a suspension rope 60 through screws in the second joining slot 117 on the left side and right side of each lamp 10. Corresponding connecting holes 52 and power connecting holes 53 can be opened on the ceiling 50. In the end, connect the power cords and lock the suspension rope 60 in the connecting hole 52, so that the whole lamp is suspended below the ceiling 50. The prior-art lamps cannot be joined, and the square slots on the ceiling must be opened separately, and when installing the lamps, each lamp must be installed separately. Comparing the prior art, the present invention provides great convenience for decoration and lamp installation.

Although the invention has been explained in relation to its preferred embodiment, it is to be understood that many other possible modifications and variations can be made without departing from the spirit and scope of the invention as hereinafter claimed.

What is claimed is:

1. A joinable lamp structure, which is an entire lamp device made by joining at least two lamps end to end, wherein, each lamp comprises an outer shell covering on the outside and a light emitting component installed inside the outer shell, the outer shell is in a cuboid bar shape, and can be divided into a long side lateral face and a short side lateral face, at the positions of a certain distance to the head and tail ends, the long side lateral face is provided with an inserting slot recessed inward and going out upward, the bottoms of the head and tail ends are respectively protruded with a stop block, a limiting space is formed between the stop block and the long side lateral face, the bottoms of the two stop blocks of the long side lateral face extends outward to form a positioning stop plate, the short side lateral face of the outer shell is recessed on the head end and the tail end, so that a positioning convex bar is respectively formed on the left side and the right side, the top face of the outer shell is respectively provided with a first joining slot at positions of a certain distance to the head end and the tail end, and a second joining slot is formed at the middle positions of the left side and the right side, when the head and tail ends of the two neighboring lamps are aligned and placed end to end, a joining component can be used to connect the two lamps, the joining component is formed by connecting a left side edge, a right side edge, and a top edge and is shaped like a C, the bottom edge in the middle of the outer wall of the side edge is recessed and is protruded with a pair of inserting plates, between the two inserting plates, a clamping slot is formed, the head and tail ends of the side edge is formed with a connecting lug, the top edge is provided with a connecting hole at the middle positions of the head and tail ends, align the head end and the tail end of the two neighboring lamps so that the neighboring positioning convex bars are correspondingly put together, and align the open mouth of the C-shaped joining component to the outside of the ends of the two neighboring lamps and insert in from above, so that the connecting lug of the joining component is inserted into the corresponding inserting slot, the inserting plate of the joining component is correspondingly inserted into a limiting space, and is immediately pressed by the stop block, the clamping slot of the joining component perfectly clamps the bent and connected walls of the two neighboring stop blocks, each connecting hole of the joining component corresponds to a first joining slot, a connecting component is inserted from above, passing the connecting hole and is locked in the first joining slot, so that the joining component is connected with the ends of the two neighboring lamps on the outside.

2. The joinable lamp structure of claim 1, wherein the exposed ends of the outer shell is covered by a side cap, the side cap has a vertical wall, the top edge of the vertical wall is folded inward and extended to form a top wall, and at a position close to the middle of the front edge, a connecting hole is provided, the inner face of the vertical wall is respectively configured with an abutting wall at positions close to the left side and right side, the left side edge and right side edge of the vertical wall are respectively configured with an upside-down L-shaped limiting plate, the folding position of the upside-down L-shape forms an abutting space, the bottom edge of the vertical wall is folded toward the outside and is expanded to form a positioning stop plate, press the side cap upon the exposed end of the lamp, so that the two abutting walls on the inner surface of the vertical wall are both pressed upon the wall in the recessed space on the short side lateral face of the outer shell, the two positioning convex bars on the short side lateral face of the outer shell are respectively pressed upon the two side edges on the inner face of the vertical wall, the upside-down L-shaped limiting plate goes through the abutting space and is pressed upon the stop block of the outer shell, the positioning stop plate is connected to the positioning stop plate of the outer shell, the top wall covers the top side of the end of the outer shell, and the connecting hole of the top wall is aligned to the first joining slot of the outer shell, a connecting component goes from above and through the connecting hole of the top wall and is locked with the first joining slot, so that the side cap firmly covers the end of the outer shell.

3. The joinable lamp structure of claim 1, wherein the second joining slot of each lamp is fixed through a screw with a limiting and connecting plate, the limiting and connecting plate is a plate extending downward and then outward and upward for several cycles to have an elasticity, the ceiling is provided with a long shaped hollow locking slot, its length and width is equal to the length and width of the complete joined lamp, the joined lamp is lifted up, the limiting and connecting plate is firstly shrunk inward so that it can pass the locking slot, till the positioning stop plate is pressed upon the ceiling, during the course, the limiting and connecting plate is elastically recovered outward and is fixed on the top edge of the locking slot, so that the whole lamp device is embedded inside the locking slot without separation.

4. The joinable lamp structure of claim 1, wherein the second joining slot of each lamp is fixed through a screw with a suspension rope, the suspension rope is a line-shaped object extending upward, the ceiling is configured with multiple corresponding connecting holes, the joined lamp device is lifted up, each suspension rope is connected to its corresponding connecting hole, so that the whole lamp device is suspended below the ceiling without separation.

* * * * *